US011686177B2

(12) United States Patent
AlSultan et al.

(10) Patent No.: US 11,686,177 B2
(45) Date of Patent: Jun. 27, 2023

(54) SUBSURFACE SAFETY VALVE SYSTEM AND METHOD

(71) Applicant: Saudi Arabian Oil Company, Dhahran (SA)

(72) Inventors: Fuad A. AlSultan, Abqaiq (SA); Abdulrahman Mishkhes, Dhahran (SA); Hisham I. Al-Shuwaikhat, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 67 days.

(21) Appl. No.: 17/450,425

(22) Filed: Oct. 8, 2021

(65) Prior Publication Data

US 2023/0116558 A1 Apr. 13, 2023

(51) Int. Cl.
*E21B 34/14* (2006.01)
*E21B 47/07* (2012.01)

(52) U.S. Cl.
CPC ..... *E21B 34/14* (2013.01); *E21B 47/07* (2020.05)

(58) Field of Classification Search
CPC ..... E21B 34/14; E21B 47/07
See application file for complete search history.

(56) References Cited

U.S. PATENT DOCUMENTS 1,766,368 A 6/1930 Wigle
3,040,811 A * 6/1962 Boer ..... E21B 34/10 166/120
3,642,070 A * 2/1972 Taylor ..... F16K 11/065 166/55.3
3,860,066 A * 1/1975 Pearce ..... E21B 34/101 166/72
4,421,174 A * 12/1983 McStravick ..... E21B 34/108 166/321

(Continued)

FOREIGN PATENT DOCUMENTS

EP 0418057 3/1991
WO WO 2020152478 7/2020

OTHER PUBLICATIONS

AlAjmi, Mohammed et al.; "Profiling Downhole Casing Integrity Using Artificial Intelligence"; Society of Petroleum Engineers; SPE Digital Energy Conference and Exhibition; The Woodlands, Texas; Mar. 5, 2015; pp. 1-13.

(Continued)

*Primary Examiner* — Steven A MacDonald
(74) *Attorney, Agent, or Firm* — Fish & Richardson P.C.

(57) ABSTRACT

The well system includes a casing and production tubing and a control unit that can receive measurements of temperature and pressure of fluid in the tubing-casing annulus (TCA). A subsurface safety valve (SSSV) connected to the tubing can switch to an open or closed state in response to a change in pressure of the fluid. An expected thermal expansion or contraction of the TCA fluid is calculated based on the received measurements, and the control unit determines, based on the expected thermal expansion or contraction and on a calculated TCA volume, a volume necessary to be added to or released from the TCA to maintain the fluid within an optimal pressure range. The control unit can also receive an indication of an emergency condition and transmit a signal to activate a release valve to release from the TCA a volume of fluid sufficient to cause the SSSV to close.

20 Claims, 4 Drawing Sheets

(56) References Cited

U.S. PATENT DOCUMENTS

| | | | | |
|---|---|---|---|---|
| 4,495,998 | A * | 1/1985 | Pringle | E21B 34/10 166/321 |
| 6,041,860 | A | 3/2000 | Nazzal et al. | |
| 6,095,583 | A | 8/2000 | Beeman et al. | |
| 6,230,811 | B1 | 5/2001 | Ringgenberg et al. | |
| 6,234,250 | B1 * | 5/2001 | Green | E21B 47/003 175/65 |
| 6,293,346 | B1 * | 9/2001 | Patel | E21B 34/08 166/324 |
| 6,431,270 | B1 | 8/2002 | Angle | |
| 6,880,641 | B2 | 4/2005 | Dennistoun et al. | |
| 6,991,040 | B2 | 1/2006 | Hill et al. | |
| 7,107,154 | B2 | 9/2006 | Ward | |
| 7,346,455 | B2 | 3/2008 | Ward et al. | |
| 7,363,980 | B2 * | 4/2008 | Pringle | E21B 34/08 166/332.8 |
| 7,526,944 | B2 | 5/2009 | Sabata et al. | |
| 7,711,486 | B2 | 5/2010 | Thigpen et al. | |
| 8,041,517 | B2 | 10/2011 | Thayer et al. | |
| 8,397,815 | B2 | 3/2013 | MacDougall et al. | |
| 9,291,033 | B2 | 3/2016 | Scott et al. | |
| 9,581,011 | B2 | 2/2017 | Tjhang | |
| 10,107,932 | B2 | 10/2018 | Miskhkes | |
| 2001/0037675 | A1 | 11/2001 | Kuo | |
| 2003/0196804 | A1 * | 10/2003 | Riet | E21B 21/106 166/267 |
| 2007/0256942 | A1 | 11/2007 | Atherton | |
| 2008/0173454 | A1 * | 7/2008 | Smithson | E21B 23/04 166/324 |
| 2010/0300184 | A1 | 12/2010 | Wayman et al. | |
| 2012/0136577 | A1 | 5/2012 | Dria et al. | |
| 2013/0087328 | A1 | 4/2013 | Maida, Jr. et al. | |
| 2013/0304680 | A1 | 11/2013 | Bailey et al. | |
| 2014/0214326 | A1 | 7/2014 | Samuel et al. | |
| 2019/0368312 | A1 * | 12/2019 | Cook | E21B 34/10 |
| 2020/0095843 | A1 * | 3/2020 | Vick, Jr. | E21B 34/08 |
| 2020/0392811 | A1 * | 12/2020 | Vick, Jr. | F04B 19/24 |
| 2020/0392812 | A1 * | 12/2020 | Vick, Jr. | F04B 17/04 |

OTHER PUBLICATIONS

Al-Janabi, Yahya T. et al.; "Monitoring of Downhole Corrosion: An Overview"; Society of Petroleum Engineers; Annual Technical Symposium and Exhibition; Khobar, Saudi Arabia; May 22, 2013, 1-11.

Brill et al., "Electromagnetic Casing Inspection Tool for Corrosion Evaluation", IPTC 14865, Copyright 2011, 14 pages.

Garcia, Javier et al.; "Successful Application of a New Electromagnetic Corrosion Tool for Well Integrity Evaluation in Old Wells Completed with Reduced Diameter Tubular"; Society of Petroleum Engineers, International Petroleum Technology Conference; Beijing, China, Mar. 28, 2013, 1-12.

Wheeler et al., "Improving Field Economics Through the Use of Modern Casing-Corrosion Logging Tools and Techniques," SPE 49297, Copyright 1998, 16 pages.

* cited by examiner

SUBSURFACE SAFETY VALVE SYSTEM AND METHOD

TECHNICAL FIELD

This disclosure relates generally to fluid flow control within a subterranean well and in particular, to subsurface safety valves located downhole within the subterranean well.

BACKGROUND

In hydrocarbon production, a wellbore is drilled into a hydrocarbon-rich geological formation. After the wellbore is partially or completely drilled, a completion system is installed to secure the wellbore in preparation for production or injection. The completion system can include casing cemented in the wellbore to help control the well and maintain well integrity, and a production tubing positioned within the casing through which oil, gas, or other produced fluids can flow from the producing formation to the surface.

A subsurface safety valve can be installed on the production tubing some distance below the surface. The subsurface safety valve can be configured to close in the event of an emergency or other condition, thereby preventing flow of fluid from the production tubing.

SUMMARY

This disclosure describes a relates generally to fluid flow control within a subterranean well and in particular, to subsurface safety valves located downhole within the subterranean well. Certain aspects of the subject matter herein can be implemented as a well system. The well system includes a production tubing positioned within a casing within a wellbore. An inner surface of the casing and an outer surface of the production tubing partially define a tubing-casing annulus. A subsurface safety valve connected to the production tubing is configured to selectively switch, in response to a change in pressure of a fluid in the tubing-casing annulus, between an open state in which produced fluid is permitted through the production tubing and a closed state in which produced fluid is prevented from flowing through the production tubing. The system also includes control unit including a non-transitory computer readable medium storing computer instructions executable by one or more processors to perform operations. The operations include receiving measurements of temperature and pressure of the fluid in the tubing-casing annulus, calculating an expected thermal expansion or contraction of the fluid in the tubing-casing annulus based on the received measurements, and determining, based on the expected thermal expansion or contraction of the fluid in the tubing-casing annulus and on a calculated volume of the tubing-casing annulus, a volume of the fluid necessary to be added to or released from the tubing-casing annulus to maintain the fluid within an optimal pressure range in the tubing-casing annulus for normal operations in which the subsurface safety valve is in the open state. The operations also include receiving an indication of an emergency condition, and transmitting, in response to the receipt of the indication of the emergency condition, a signal to activate a release valve to release, from the tubing-casing annulus, a volume of fluid sufficient to cause the subsurface safety valve to switch from the open state to the closed state.

An aspect combinable with any of the other aspects can include the following features. The operations also include, in response to a determination by the control unit that an additional volume of fluid is necessary to maintain the fluid within the optimal pressure range in the tubing-casing annulus for normal operations, transmitting a signal to activate a pump to add the additional volume of fluid to the tubing-casing annulus.

An aspect combinable with any of the other aspects can include the following features. The operations also include, in response to a determination by the control unit that a release of fluid is necessary to maintain the fluid within the optimal pressure range in the tubing-casing annulus, transmitting a signal to activate the release valve to release the fluid in a volume sufficient to maintain the fluid within the optimal pressure range.

An aspect combinable with any of the other aspects can include the following features. The pump draws the additional volume from a tank disposed at the surface, and wherein the tank is configured to receive the fluid released from the tubing-casing annulus.

An aspect combinable with any of the other aspects can include the following features. The subsurface safety valve includes a main body with a central bore therethrough fluidically connected to the production tubing. The subsurface safety valve also includes a closure member that permits fluid flow through the central bore when in an open position and that prevents fluid flow through the central bore when in a closed position, wherein the subsurface safety valve is in the open state when the closure member is in the open position and in the closed state when the closure member is in a closed position. The subsurface safety valve also includes a pressure orifice through the main body having an outer end and an inner end. The outer end is exposed to a pressure of fluid in the tubing-casing annulus. The subsurface safety valve also includes a piston partially defining a piston chamber which is fluidically connected to the inner end of the pressure orifice. The piston configured to move the closure member to the open position in response to an increase in pressure in the pressure chamber.

An aspect combinable with any of the other aspects can include the following features. The piston is configured to allow movement of the closure member from the open position to the closed position in response to a decrease in the pressure of the fluid in the tubing-casing annulus.

An aspect combinable with any of the other aspects can include the following features. A pressure of fluid in the piston chamber is equal to the pressure of the fluid in the tubing-casing annulus.

An aspect combinable with any of the other aspects can include the following features. A downhole boundary of the tubing-casing annulus is defined by an upper surface of an annular production packer element.

An aspect combinable with any of the other aspects can include the following features. The volume of fluid sufficient to cause the subsurface safety valve to switch from the open state to the closed state is determined based in part on the calculated expected thermal expansion or contraction of the fluid in the tubing-casing annulus based on the received measurements.

An aspect combinable with any of the other aspects can include the following features. The calculating an expected thermal expansion or contraction of the fluid in the tubing-casing annulus based on the received measurements is in real-time with the received measurements.

Certain aspects of the subject matter herein can be implemented as method. The method includes receiving, by a control unit comprising a non-transitory computer readable medium storing computer instructions executable by one or more processors to perform operations, measurements of temperature and pressure of a fluid in a tubing-casing annulus defined by an inner surface of a casing positioned in a wellbore and an outer surface of a production tubing positioned within the casing. A subsurface safety valve is connected to the production tubing and is configured to selectively switch, in response to a change in pressure of the fluid in the tubing-casing annulus, between an open state in which produced fluid is permitted through the production tubing and a closed state in which produced fluid is prevented from flowing through the production tubing. The method also includes calculating, by the control unit, an expected thermal expansion or contraction of the fluid in the tubing-casing annulus based on the received measurements and determining, by the control unit and based on the expected thermal expansion or contraction of the fluid in the tubing-casing annulus and a calculated volume of the tubing-casing annulus, a volume of the fluid necessary to be added to or released from the tubing-casing annulus to maintain the fluid within an optimal pressure range in the tubing-casing annulus for normal operations in which the subsurface safety valve is in the open state. The method also includes receiving, by the control unit, an indication of an emergency condition and transmitting, by the control unit and in response to the receipt of the indication of the emergency condition, a signal to activate a release valve to release from the tubing-casing annulus a volume of fluid sufficient to cause the subsurface safety valve to switch from the open state to the closed state.

An aspect combinable with any of the other aspects can include the following features. The method also includes transmitting, by the control unit and in response to a determination by the control unit that an additional volume of fluid is necessary to maintain the fluid within the optimal pressure range in the tubing-casing annulus for normal operations, a signal to activate a pump to add the additional volume of fluid to the tubing-casing annulus.

An aspect combinable with any of the other aspects can include the following features. The method also includes transmitting, by the control unit and in response to a determination by the control unit that a release of fluid is necessary to maintain the fluid within the optimal pressure range in the tubing-casing annulus, a signal to activate the release valve to release the fluid in a volume sufficient to maintain the fluid within the optimal pressure range.

An aspect combinable with any of the other aspects can include the following features. The pump draws the additional volume from a tank disposed at the surface, and the tank is configured to receive the fluid released from the tubing-casing annulus.

An aspect combinable with any of the other aspects can include the following features. The subsurface safety valve includes a main body with a central bore therethrough and which is fluidically connected to the production tubing. The subsurface safety valve also includes a closure member that permits fluid flow through the central bore when in an open position and that prevents fluid flow through the central bore when in a closed position. The subsurface safety valve is in the open state when the closure member is in the open position and in the closed state when the closure member is in a closed position. The subsurface safety valve also includes a pressure orifice through the main body having an outer end and an inner end, and the outer end is exposed to a pressure of fluid in the tubing-casing annulus. The subsurface safety valve also includes a piston partially defining a piston chamber. The piston chamber is fluidically connected to the inner end of the pressure orifice, and the piston is configured to move the closure member to the open position in response to an increase in pressure in the piston chamber An aspect combinable with any of the other aspects can include the following features. The piston is configured to allow the closure member to move from the open position to the closed position in response to a decrease in the pressure of the fluid in the tubing-casing annulus.

An aspect combinable with any of the other aspects can include the following features. A pressure of fluid in the piston chamber is equal to the pressure of the fluid in the tubing-casing annulus.

An aspect combinable with any of the other aspects can include the following features. A downhole boundary of the tubing-casing annulus is defined by an upper surface of an annular production packer element.

An aspect combinable with any of the other aspects can include the following features. The volume of fluid sufficient to cause the subsurface safety valve to switch from the open state to the closed state is determined based in part on the calculated expected thermal expansion or contraction of the fluid in the tubing-casing annulus based on the received measurements.

An aspect combinable with any of the other aspects can include the following features. The calculating an expected thermal expansion or contraction of the fluid in the tubing-casing annulus is based on the received measurements is in real-time with the received measurements.

The details of one or more embodiments are set forth in the accompanying drawings and the description below. Other features, objects, and advantages will be apparent from the description and drawings, and from the claims.

DETAILED DESCRIPTION

Subsurface safety valves (SSSVs) can provide a fail-safe mechanism for preventing fluid flow through a production tubing in the event of an emergency or other condition. SSSVs can be controlled via hydraulic pressure from a control line extending from the surface to the SSSV. However, control lines and their associated equipment can be subject to leaks and wear and tear.

In accordance with an embodiment of the present disclosure, a subsurface safety valve can be operated via an application or release of fluid pressure in the tubing-casing annulus. The valve does not rely on a control line, and so leaks, breakage, and maintenance requirements associated with a control line are reduced or eliminated.

In accordance with an embodiment of the present disclosure, the well system includes a surface tank, pump, and associated piping and valves to controllably add or release fluid to the tubing-casing annulus. A control system can monitor annular fluid pressure and temperature and calculate the volumes of fluid required to be added to or released from the tubing-casing annulus to maintain the fluid pressure within an optimum pressure range during normal operations, and control the pump and valves to add or release the required fluid volumes. The control system can also recognize an emergency condition and open the release valve to rapidly bleed fluid from the tubing-casing annulus and thereby quickly close the subsurface safety valve. Thus the well system is controlled efficiently and with fewer subsurface lines, seals, connections and other components that may be subject to wear, tear, and/or leaks.

In accordance with an embodiment of the present disclosure, the control system can determine an expected thermal expansion or contraction of the fluid in the tubing-casing annulus, and, with that determination, more accurately determine an emergency condition and/or the amount of fluid that needs to be added to keep the fluid pressure within the optimum pressure range. Well operations can be conducted more efficiently with less risk of leaks, premature valve closure, or other costly interruptions.

Figure 1:
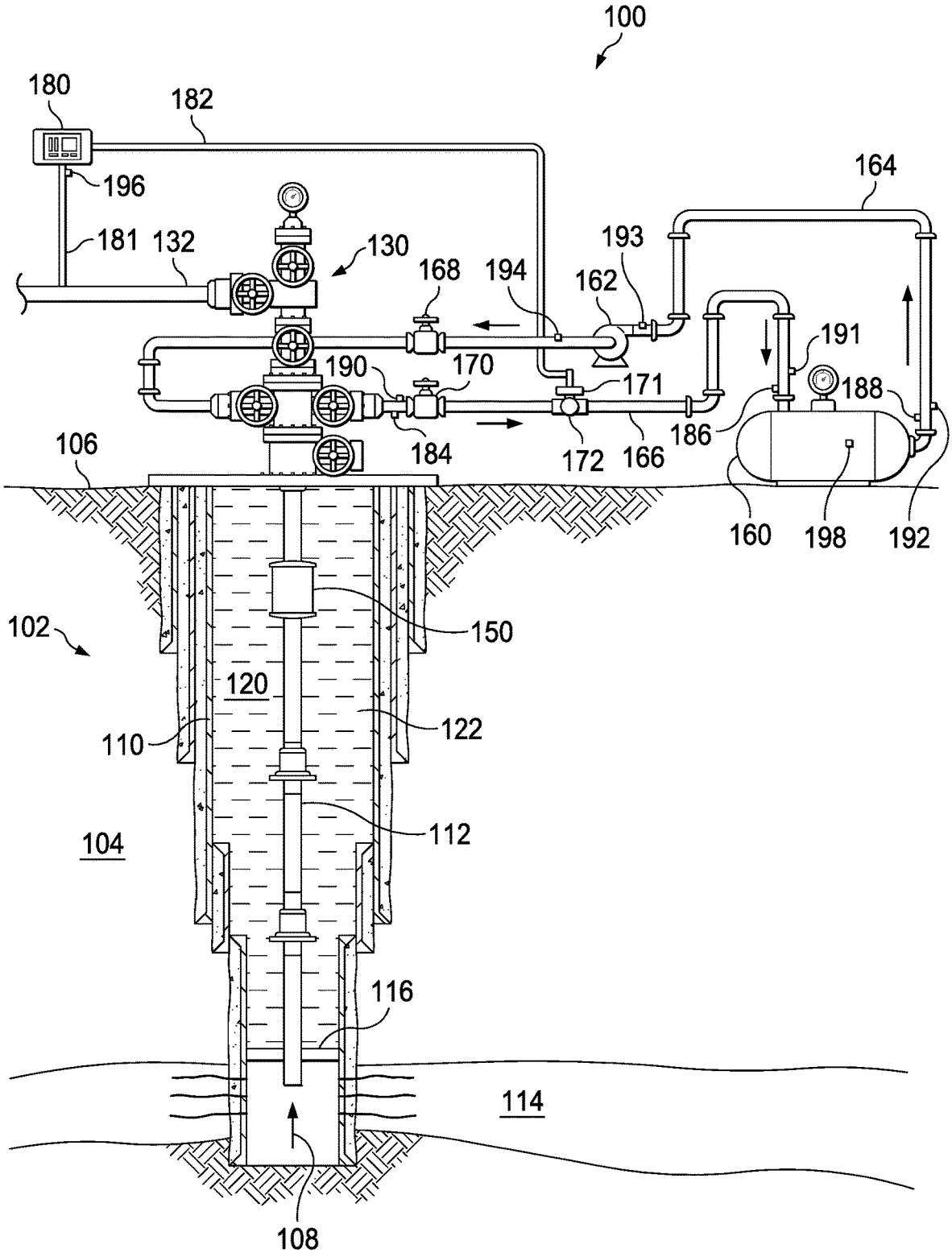
FIG. 1 is a schematic illustrations of a well system in accordance with an embodiment of the present disclosure.

FIG. 1 is a schematic illustrations of a well system in accordance with an embodiment of the present disclosure. Referring to FIG. 1, well system 100 includes a wellbore 102 drilled into a subterranean zone 104 from the Earth's surface 106. Casing string 110 can include multiple nested casings of different diameters. For example, in some embodiments, casing string 110 can include a 18⅝" conductor nearest the wellhead at the uphole end with progressively smaller diameter casing segments extending downhole. For example, a 13⅜" casing can be cemented within 18⅝" conductor. Further downhole, a 9⅝" casing is cemented within the 13⅜" casing. Further downhole, a 7" casing is cemented within the 9⅝" casing. Furthest downhole, a 4½" casing reaches down to the producing reservoir, and can be perforated so as to allow produced fluids to flow into the cased wellbore.

Production tubing 112 is positioned within casing string 110 and provides a passageway through which produced fluid 108 from production zone 114 can reach the surface 106. In some embodiments, production tubing 112 can be a 3½" production tubing string. A production packer 116 anchors and isolates the bottom of the production tubing string.

The inner surface of casing string 110 and the outer surface of production tubing 114 define an annulus, known as the tubing-casing annulus (TCA) 120. A lower boundary of TCA 120 is defined by the upper surface of the packer elements of production packer 116. A fluid 122 fills or substantially fills the volume of the TCA 120 and can be composed of brine or diesel or other suitable fluid. In some embodiments, a corrosion inhibitor can be added to fluid 122 (such that fluid 122 can be referred to as "inhibited fluid.")

Well system 100 also includes a wellhead assembly 130 which can include hangers for casing string 110 and production tubing 114 and can include various valves, spools, pressure gauges and chokes to regulate and control production of produced fluids 108 fluids from wellbore 102. Produced fluids 108 can be conveyed towards pipelines or other surface treatment, gathering, or conveyance facilities via production line 132.

Well system 100 also includes a subsurface safety valve (SSSV) 150 connected to production tubing 112. Subsurface safety valve 150 has an open state in which produced fluid 108 is permitted through production tubing 112 to a closed state in which produced fluid 108 and any other fluids within production tubing 112 are prevented from flowing through production tubing 112. Well system 100 can be configured such that, in normal operations, subsurface safety valve 150 is in the open state. In an emergency, subsurface safety valve 150 can be switched to the closed state. As described in more detail in reference to FIGS. 2A and 2B, subsurface safety valve 150 does not require a control line connected to it and is not operated via hydraulic fluid conveyed via a control line. Instead, subsurface safety valve 150 switches between the closed state and the open state in response to a change in fluid pressure of fluid 122 in TCA 120. Specifically, subsurface safety valve 150 opens in response to application of sufficient TCA pressure. If TCA pressure drops below a specified level, subsurface safety valve 150 closes. Because it does not require a control line, subsurface safety valve 150 can be referred to as an exempted control-line device (ECLD).

Fluid 122 can be added or released from TCA 120 at the wellhead from tank 160. Pump 162 can pump fluid 122 from tank 160 into TCA 120 via fluid input line 164. Fluid 122 released from TCA 120 returns to tank 160 via fluid output line 166. Input line check valve 168 is a one-way valves which prevent return flow of fluid from fluid input line 164 into tank 160. Output line check valve 170 is a one-way valve which prevents return flow of fluid from fluid output line 166 into TCA 120. Release valve 172 can selectively release fluid from TCA 120 via fluid output line 166. Release valve 172 can be opened or closed by actuator 171. As described in greater detail below, by adding or releasing fluid from TCA 120, the fluid pressure within TCA 120 can be controlled so as to operate subsurface safety valve 150.

Well system 100 also includes emergency shut-down (ESD)/control unit 180. Control unit 180 can be (or can include) a computer system that comprises one or more processors, and a computer-readable medium (for example, a non-transitory computer-readable medium) storing computer instructions executable by the one or more processors to perform operations. Control unit 180 can be (or can include) a computer system 400 as shown, and described in more detail, in FIG. 4. In some embodiments, control unit 180 is at the wellsite proximate to wellhead assembly 130 and other wellsite equipment. In other embodiments, control unit 180 can be remote from the wellsite. In some embodiments, control unit 180 can be in communication with other remote or wellsite monitoring and control systems. In some embodiments, control unit 180 can be (or can be part of, or be connected to) a supervisory control and data acquisition (SCADA) system.

System 100 can include various sensors. In the illustrated embodiment, system 100 includes temperatures sensor 184 and pressure sensor 190 positioned within fluid line 166 as it exits wellhead assembly 130. So positioned before check valve 170, temperature sensor 184 and pressure sensor 190 can measure the temperature and pressure of the fluid 122 in TCA 120. In other embodiments, temperature sensor 184 and/or pressure sensor 190 and/or other suitable temperature, pressure, and/or other sensors can be positioned inside of TCA 120 itself. In the illustrated embodiment, system 100 further includes temperature sensor 186 and pressure sensor 191 to measure the temperature and pressure of fluid as it as it enters tank 160, and temperature sensor 188 and pressure sensor 192 to measure the temperature and pressure of fluid as it as it exits tank 160. In addition, pressure sensors 193 and 194 measure intake and outtake pressure, respectively, at pump 162. Pressure sensor 196 can be positioned within or proximate to control unit 180, and can measure the fluid pressure in line 132 via hydraulic connection 181 that connects control unit 180 with production line 132. Sensor 198 can measure the fluid level within tank 160. The aforementioned sensors can be in wired or wireless connection with control unit 180, such that control unit 180 can receive measurements of pressure, flow rate, and other parameters. Control unit 180 can transmit operational command signals to pump 162 and to actuate valve actuator 171. In the illustrated embodiment, a hydraulic control line 182 connects control unit 180 with actuator 171, such that the activation of actuator 171 can be via hydraulic pressure applied through control line 182.

Control unit 180 can be configured to determine whether an emergency condition in well system 100 has occurred or is occurring. For example, a sudden increase in pressure in production line 132 can indicate a kick or other well control event. A sudden decrease in pressure can indicate a leak in the production tubing, casing, or other well component. Control unit 180 can, in response to such a detection of an emergency condition (or other condition in which closure of subsurface safety valve 150 is desirable), transmit a signal to valve actuator 171 to release fluid from TCA 120 in a volume sufficient to reduce fluid pressure in TCA 120 to the point where subsurface safety valve 150 closes. Control unit 180 can also transmit an audible or visual alarm or transmit other suitable communications or signals in response to the alarm determination.

Pressure of fluid 122 in the relatively large volume of TCA 120 can vary due to factors such as expansion and/or contraction caused by variations in fluid temperature. Such variations caused by thermal expansion/contraction could result in, for example, a premature closing of SSSV 150 (if pressure dips below the pressure at which SSSV 150 switches to the closed position) and/or leaks in the tubing, casing, or other components (if annular fluid pressure is too high). In accordance with an embodiment of the present invention, an operator can define an optimal fluid pressure range for fluid 122 in TCA 120 for normal operations. Within this optimal fluid pressure range, fluid pressure could vary as expected in normal operations due to factors such as thermal expansion or contraction but would be sufficiently high such that such expected variations would not trigger unwanted (premature) closure of SSSV 150 but not so high as to cause leaks or other problems or issues. In accordance with an embodiment of the present disclosure, control unit 180 maintains the TCA pressure within this optimal range, based on real-time temperature and pressure measurements and calculated expected fluid thermal contraction or expansion based on the type and volume of fluid in the TCA. Similarly, control unit 180 can recognize a leak from or into production tubing 112 into or out of TCA 120 based on pressure and temperature data and calculated expected thermal contraction or expansion, and flag such a condition to the operator. The optimal fluid pressure range can take into account flowline pressure, wellhead pressure, and the type of fluid comprising fluid 122. For example, diesel will have a greater amount of thermal expansion and contraction than water.

In some embodiments, control unit 180 can determine the volume of fluid that would be necessary to be added to or released from TCA 120 to keep the fluid pressure in the TCA to within the optimal range. For example, control unit 180 in some embodiments can calculate an expected thermal contraction or expansion of the fluid in the tubing casing annulus based on the received TCA fluid temperature and pressure measurements and based on a calculated volume of the tubing-casing annulus. The calculated volume can be calculated using the inner diameter (or diameters) of casing string 110, the outer diameter of production tubing 112, and the depth of packer 116. The control unit can then determine, based on the calculated expected thermal expansion or contraction of the fluid in the tubing-casing annulus and the calculated volume, a volume of the fluid necessary to be added to or released from TCA 120 to maintain the fluid within the optimal fluid pressure range. In some embodiments, control unit 180 can then transmit signals to pump 162 to add additional fluid to TCA 120, and/or to valve actuator 171 to release fluid from TCA 120, in the amounts as determined to maintain the fluid pressure within the optimal range. The optimal fluid pressure range can be set by the operator considering multiple factors including flowline pressure and/or wellhead pressure. Control unit 180 can track and store information regarding the type and volumes of fluid added or released from TCA 120. Such information can be useful for identifying possible leaks and to avoid over-pressurizing the TCA. Control unit 180 can calculate and track, at any given time and based on real-time temperature measurements and such fluid type information and volume measurements, any change (due to such thermal expansion or contraction) in the volume of fluid that would be necessary to be bled from TCA 120 in order to close SSSV 150, and adjust the volume that is bled from the TCA 120 accordingly if such closure becomes necessary (for example, due to a well control event).

For example, a pressure increase within a tubing-casing annulus can be calculated by control unit 180. A first equation is for the volume expansion:

$$V=V_o(1+\alpha\Delta T)$$

where V=expanded volume (in cubic inches), Vo=initial volume in cubic inches, α=fluid thermal expansion coefficient in ° F.$^{-1}$, and ΔT=average fluid temperature change in ° F. A second equation is for the fluid pressure change:

$$\Delta P = \frac{V - V_o}{V_o C}$$

where ΔP=fluid pressure change in psi, and C=fluid compressibility factor in psi$^{-1}$. A third equation combines the first and second equations:

$$\Delta P = \frac{\alpha\Delta T}{C}$$

For example, given 10,000 feet of 3½ inch tubing inside 7 inch (35 pounds per foot) casing having an inner diameter of 6.004 inches, and assuming 8.6 ppg water-based completion fluid that heats up an average of 70° F. during production. A fluid expansion that would be expected to result if the fluid were bled off can be calculated, and the resulting pressure change can likewise be calculated:

$$V_o = \frac{10000*\left(\frac{\pi}{4}\right)*\left(6.004^2 - 3.5^2\right)}{144} = 1{,}298\ \text{ft}^2 = 231.2\ \text{bbls}$$

$$V = 231.2\left[1 + 2.5*10^{-4}*70)\right] = 235.2\ \text{bbls}$$

$$V - V_0 = 235.2 - 231.2 = 4.0\,\text{bbls}$$

$$\Delta P = \frac{2.5*10^{-4}*70}{2.8*10^{-6}} = 6{,}250\ \text{psi}$$

The above equations assume that the casing and tubing form a rigid container; however, the equations can be suitably modified to take into account less rigid components and/or other variables.

Figure 2A:
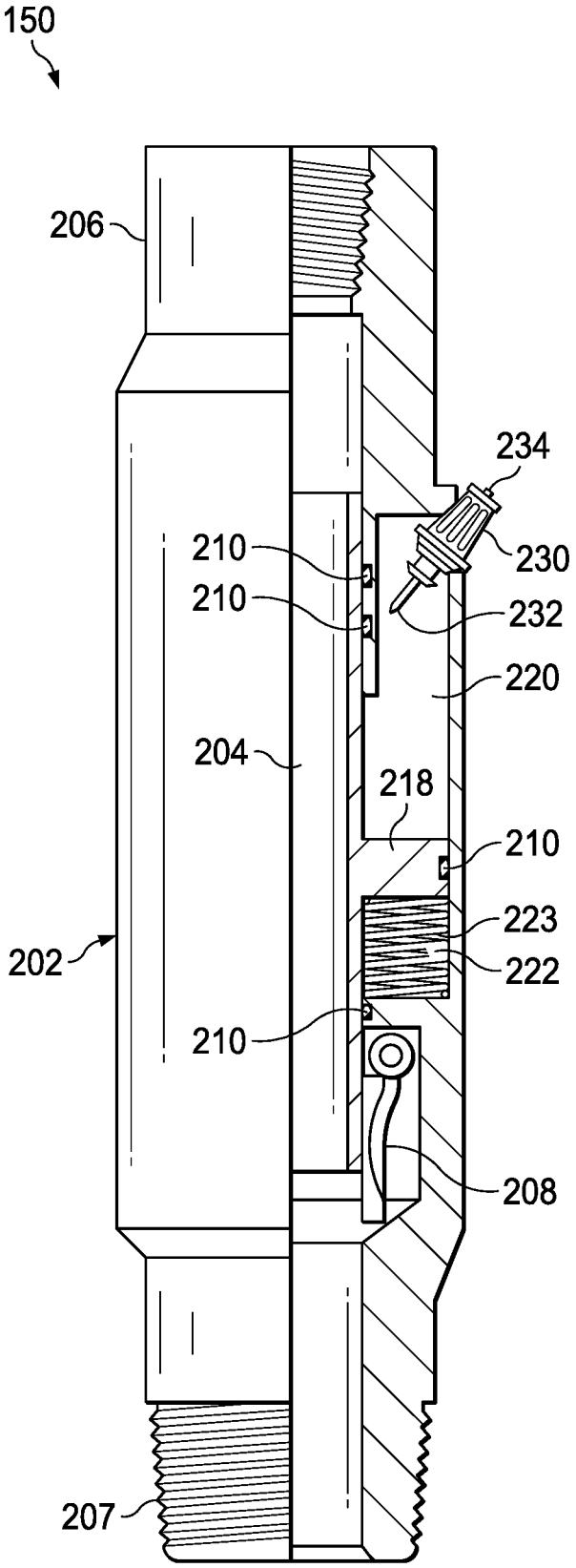
FIGS. 2A and 2B are schematic illustrations of a subsurface safety valve in accordance with an embodiment of the present disclosure.
Figure 2B:
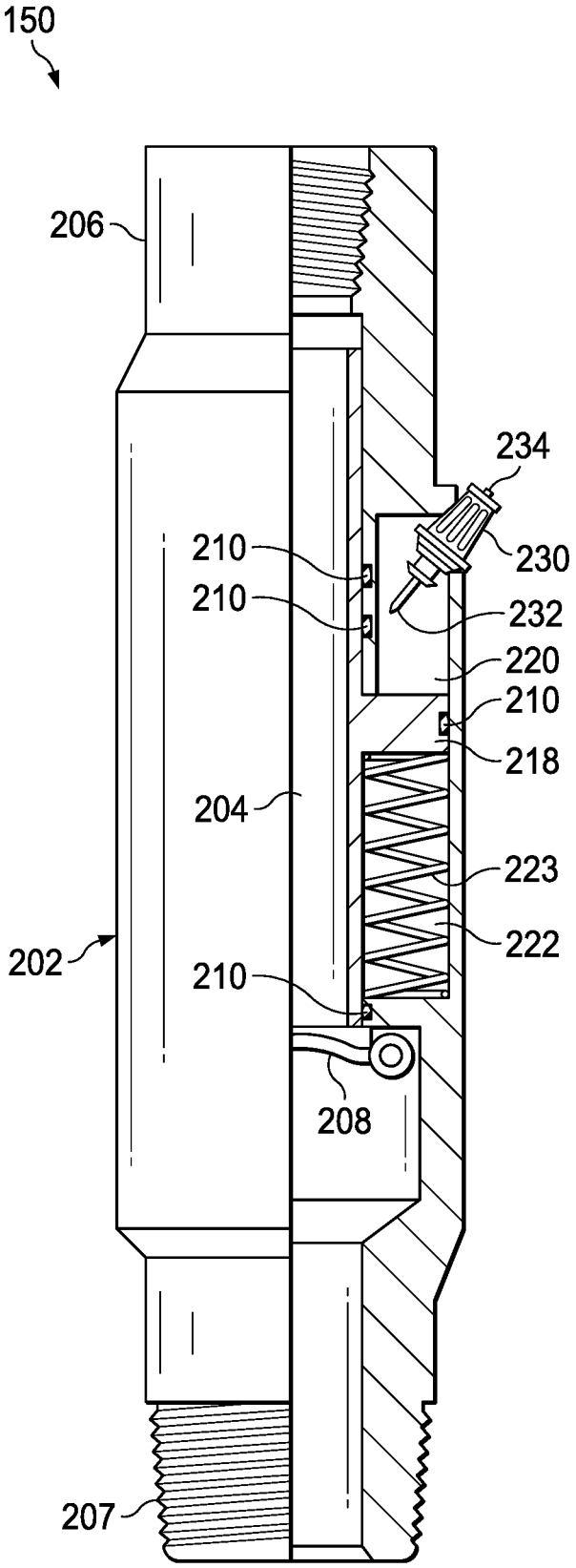

FIGS. 2A and 2B are schematic illustrations showing more detail of subsurface safety valve 150 in accordance with an embodiment of the present disclosure. Referring to FIG. 2A, SSSV 150 includes a main body 202 with central bore 204. Threaded upper end 206 and lower end 207 can be connected to production tubing (such as production tubing 112 of FIG. 1).

Closure member 208 permits fluid flow through central bore 204 when in an open position (as shown in FIG. 2A) and that prevents fluid flow through the central bore when in a closed position (as shown in FIG. 2B). In the illustrated embodiment, closure member 208 is a flapper. In some embodiments, closure member 208 can be a ball, poppet, or other type of closure member. SSSV 150 is in its open state when closure member 208 is in the open position (FIG. 2A) and in its closed state when closure member is in a closed position (FIG. 2B). SSSV 150 includes a piston 218 which can push closure member 208 to the open position. Piston 218 partially defines an upper piston chamber 220 and a lower piston chamber 222. Seals 210 prevent pressure migration between central bore 204 and upper piston chamber 220, and also isolate lower piston chamber 222 from upper piston chamber 220 and central bore 204. Piston 218 is biased to the closed position by spring 223.

Pressure orifice 230 extends through main body 202 and has an inner end 232 within upper piston chamber 220 and an outer end 234 exposed to the tubing-casing annulus (for example, TCA 120 of FIG. 1). Pressure orifice 230 can be a hollow tube or other passageway which allows fluid communication between the tubing-casing annulus and upper piston chamber 220, allowing pressure equalization between upper piston chamber 220 and the tubing-casing annulus, such that the fluid pressure in upper piston chamber 220 will be equal to the fluid pressure in the tubing-casing annulus. Lower piston chamber 222 is a closed chamber with a pressure set prior to deployment. An increase in pressure in the tubing-casing annulus increases the pressure in upper piston chamber 220 and causes a pressure differential between upper piston chamber 220 and lower piston chamber 222. If that pressure differential exceeds a threshold to overcome the biasing force of spring 223, piston 218 slides in a downhole direction, causing closure member 208 to move to the open position (FIG. 2A). When fluid pressure in the tubing-casing annulus is decreased to below this threshold, the force of spring 223 causes piston 218 to slide in the uphole direction, allowing closure member 208 to move to the closed position.

Figure 3:
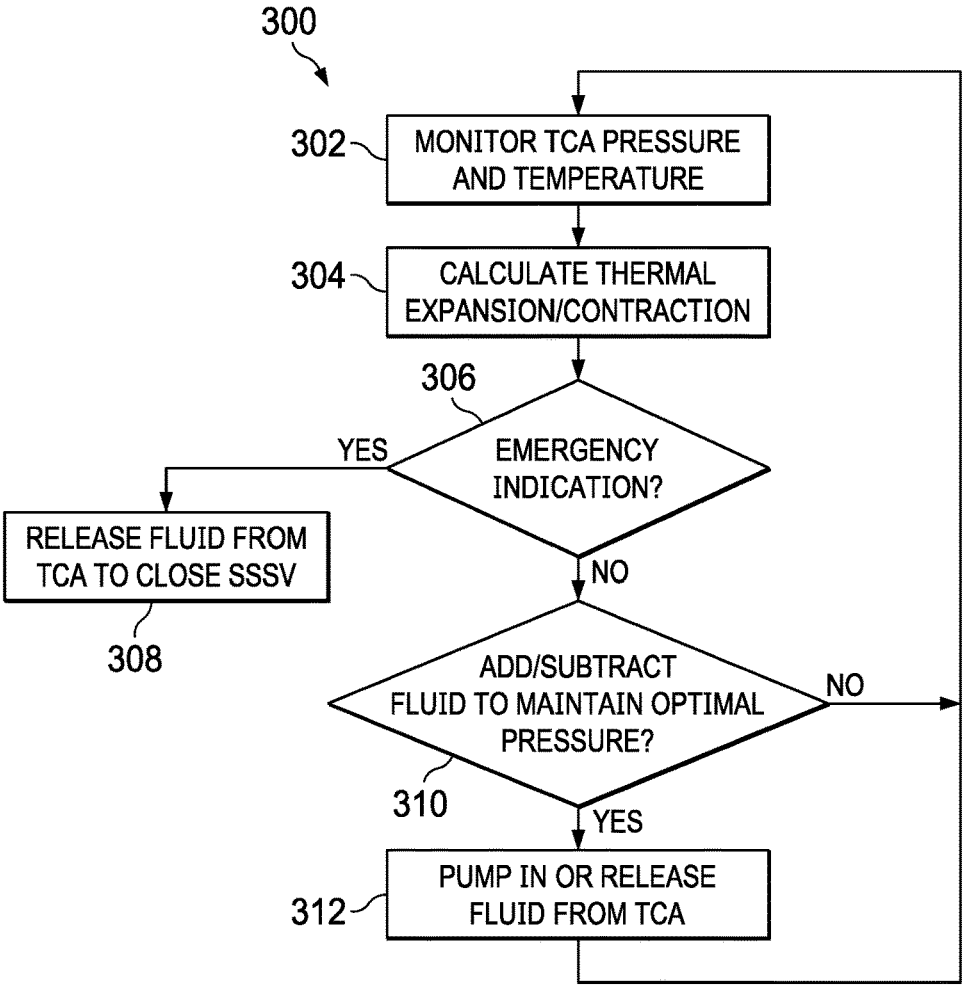
FIG. 3 is a process flow diagram of a method for operating a well system in accordance with an embodiment of the present disclosure.

FIG. 3 is a process flow diagram of a method 300 for operating a well system in accordance with an embodiment of the present disclosure. Method 300 will be described in reference to system 100 described in reference to FIG. 1. Method 300 begins at step 302 wherein a control unit (such as control unit 180 of FIG. 1) receives measurements of the pressure and/or temperature of the fluid that fills TCA 120, and of other parameters such as pressure and flow in production line 132. Proceeding to step 304, the control unit calculates an expected thermal expansion or contraction of the fluid in the tubing-casing annulus based on the received temperature and pressure measurements.

Proceeding to step 306, the control unit determines, based on the pressure, temperature, and other measurements of the fluid in the tubing-casing annulus and flowing from production tubing 112, and taking into consideration the calculated thermal expansion or contraction of the fluid, whether a well control event or other emergency or condition that would necessitate (or make desirable) closure of the subsurface safety valve. If such a condition is detected, then the method proceeds to step 308 in which the control unit sends a signal to a valve actuator to release fluid from the TCA in a volume sufficient to lower the TCA to cause closure of the subsurface safety valve, again taking into account the thermal expansion or contraction of the fluid in the tubing-casing annulus. It will be understood that, in some embodiments, the emergency condition determination of step 306 can occur continuously during well operations and/or repeatedly at other points during the method. The system can flag the occurrence of the well control event and valve closure to the operator.

If at step 306 no emergency condition is determined, then the method then proceeds to step 310 wherein the control unit determines whether a volume of fluid is necessary to be added or released from the TCA to maintain the TCA pressure within the optimum range for normal operations during which the SSSV remains open and, if so, what that volume of fluid is to be added or subtracted. This determination is made based on the expected thermal expansion or contraction of the fluid in the tubing-casing annulus as calculated in step 304, the calculated volume of the tubing-casing annulus, and other suitable factors. If at step 310 it is determined that a volume of fluid needs to added or subtracted to maintain the fluid within the optimum range, then at step 312, the control unit sends a signal to pump 162 or to the actuator 171 to add or release fluid, respectively. After the fluid is added or released at step 312, or if at step 310 it is determined that no fluid needs to be added or released, the method returns to step 302 and monitoring continues.

Figure 4:
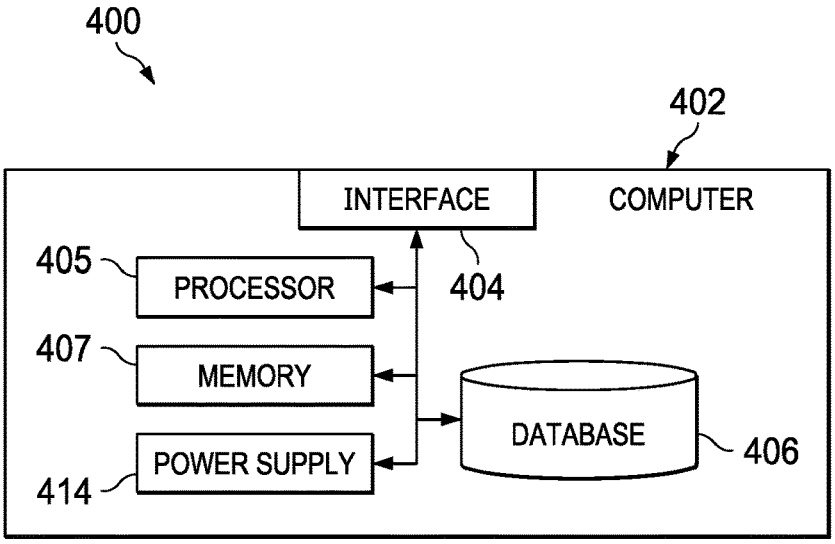
FIG. 4 is a schematic illustration of a computer system used as part of a control unit in accordance with an embodiment of the present disclosure.

FIG. 4 is a block diagram of the computer system 400 used to provide computational functionalities associated with described algorithms, methods, functions, processes, flows, and procedures, as described in this specification, according to an implementation. Control unit 180 of FIG. 1 can, in some embodiments, be (or include) a computer system 400. Computer system 400 can include computer 402 which is intended to encompass any computing device, such as a server, desktop computer, laptop/notebook computer, one or more processors within these devices, or any other processing device, including physical or virtual instances (or both) of the computing device. Additionally, the computer 402 can include a computer that includes an input device, such as a keypad, keyboard, touch screen, or other device that can accept user information, and an output device that conveys information associated with the operation of the computer 402, including digital data, visual, audio information, or a combination of information.

The computer 402 includes an interface 404. Although illustrated as a single interface 404 in FIG. 4, two or more interfaces 404 may be used according to particular needs, desires, or particular implementations of the computer 402. Although not shown in FIG. 4, the computer 402 can be communicably coupled with a network. The interface 404 is used by the computer 402 for communicating with other systems that are connected to the network in a distributed environment. Generally, the interface 404 comprises logic encoded in software or hardware (or a combination of software and hardware) and is operable to communicate with the network. More specifically, the interface 404 may comprise software supporting one or more communication protocols associated with communications, such that the network or interface's hardware is operable to communicate physical signals within and outside of the illustrated computer 402.

The computer 402 includes a processor 405. Although illustrated as a single processor 405 in FIG. 4, two or more processors may be used according to particular needs, desires, or particular implementations of the computer 402. Generally, the processor 405 executes instructions and manipulates data to perform the operations of the computer 402 and any algorithms, methods, functions, processes, flows, and procedures as described in this specification.

The computer 402 can also include a database 406 that can hold data for the computer 402 or other components (or a combination of both) that can be connected to the network. Although illustrated as a single database 406 in FIG. 4, two or more databases (of the same or combination of types) can be used according to particular needs, desires, or particular implementations of the computer 402 and the described functionality. While database 406 is illustrated as an integral component of the computer 402, database 406 can be external to the computer 402.

The computer 402 also includes a memory 407 that can hold data for the computer 402 or other components (or a combination of both) that can be connected to the network. The memory 407 is a computer-readable storage medium. Although illustrated as a single memory 407 in FIG. 4, two or more memories 407 (of the same or combination of types) can be used according to particular needs, desires, or particular implementations of the computer 402 and the described functionality. While memory 407 is illustrated as an integral component of the computer 402, memory 407 can be external to the computer 402. The memory 407 can be a transitory or non-transitory storage medium.

The memory 407 stores computer-readable instructions executable by the processor 405 that, when executed, cause the processor 405 to perform operations, such as any of the steps of method 300B. The computer 402 can also include a power supply 414. The power supply 414 can include a rechargeable or non-rechargeable battery that can be configured to be either user- or non-user-replaceable. The power supply 414 can be hard-wired. There may be any number of computers 402 associated with, or external to, a computer system containing computer 402, each computer 402 communicating over the network. Further, the term "client," "user," "operator," and other appropriate terminology may be used interchangeably, as appropriate, without departing from this specification. Moreover, this specification contemplates that many users may use one computer 402, or that one user may use multiple computers 402.

While this specification contains many specific implementation details, these should not be construed as limitations on the scope of any claims or of what may be claimed, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable sub-combination. Moreover, although features may be described as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A well system comprising:

a production tubing positioned within a casing within a wellbore, wherein an inner surface of the casing and an outer surface of the production tubing partially defines a tubing-casing annulus;

a subsurface safety valve connected to the production tubing and configured to selectively switch, in response to a change in pressure of a fluid in the tubing-casing annulus, between an open state in which produced fluid is permitted through the production tubing and a closed state in which produced fluid is prevented from flowing through the production tubing; and a control unit comprising a non-transitory computer readable medium storing computer instructions executable by one or more processors to perform operations, the operations comprising:

receiving measurements of temperature and pressure of the fluid in the tubing-casing annulus;

calculating an expected thermal expansion or contraction of the fluid in the tubing-casing annulus based on the received measurements;

determining, based on the expected thermal expansion or contraction of the fluid in the tubing-casing annulus and on a calculated volume of the tubing-casing annulus, a volume of the fluid necessary to be added to or released from the tubing-casing annulus to maintain the fluid within an optimal pressure range in the tubing-casing annulus for normal operations in which the subsurface safety valve is in the open state;

receiving an indication of an emergency condition; and transmitting, in response to the receipt of the indication of the emergency condition, a signal to activate a release valve to release, from the tubing-casing annulus, a volume of fluid sufficient to cause the subsurface safety valve to switch from the open state to the closed state.

2. The system of claim 1, wherein the operations further comprise, in response to a determination by the control unit that an additional volume of fluid is necessary to maintain the fluid within the optimal pressure range in the tubing-casing annulus for normal operations, transmitting a signal to activate a pump to add the additional volume of fluid to the tubing-casing annulus.

3. The system of claim 2, wherein the operations further comprise, in response to a determination by the control unit that a release of fluid is necessary to maintain the fluid within the optimal pressure range in the tubing-casing annulus, transmitting a signal to activate the release valve to release the fluid in a volume sufficient to maintain the fluid within the optimal pressure range.

4. The system of claim 3, wherein the pump draws the additional volume from a tank disposed at the surface, and wherein the tank is configured to receive the fluid released from the tubing-casing annulus.

5. The system of claim 1, wherein subsurface safety valve comprises:

a main body with a central bore therethrough, the central bore fluidically connected to the production tubing;

a closure member that permits fluid flow through the central bore when in an open position and that prevents fluid flow through the central bore when in a closed position, wherein the subsurface safety valve is in the open state when the closure member is in the open position and in the closed state when the closure member is in a closed position;

a pressure orifice through the main body having an outer end and an inner end, wherein the outer end is exposed to a pressure of fluid in the tubing-casing annulus;

a piston partially defining a piston chamber, the piston chamber fluidically connected to the inner end of the pressure orifice, the piston configured to move the closure member to the open position in response to an increase in pressure in the pressure chamber.

6. The system of claim 5, wherein the piston is configured to allow movement of the closure member from the open position to the closed position in response to a decrease in the pressure of the fluid in the tubing-casing annulus.

7. The system of claim 5, wherein a pressure of fluid in the piston chamber is equal to the pressure of the fluid in the tubing-casing annulus.

8. The system of claim 1, wherein a downhole boundary of the tubing-casing annulus is defined by an upper surface of an annular production packer element.

9. The system of claim 1, wherein the volume of fluid sufficient to cause the subsurface safety valve to switch from the open state to the closed state is determined based in part on the calculated expected thermal expansion or contraction of the fluid in the tubing-casing annulus based on the received measurements.

10. The system of claim 1, wherein the calculating an expected thermal expansion or contraction of the fluid in the tubing-casing annulus based on the received measurements is in real-time with the received measurements.

11. A method, comprising:

receiving, by a control unit comprising a non-transitory computer readable medium storing computer instructions executable by one or more processors to perform operations, measurements of temperature and pressure of a fluid in a tubing-casing annulus defined by an inner surface of a casing positioned in a wellbore and an outer surface of a production tubing positioned within the casing, wherein a subsurface safety valve is connected to the production tubing and is configured to selectively switch, in response to a change in pressure of the fluid in the tubing-casing annulus, between:

an open state in which produced fluid is permitted through the production tubing; and a closed state in which produced fluid is prevented from flowing through the production tubing;

calculating, by the control unit, an expected thermal expansion or contraction of the fluid in the tubing-casing annulus based on the received measurements;

determining, by the control unit and based on the expected thermal expansion or contraction of the fluid in the tubing-casing annulus and a calculated volume of the tubing-casing annulus, a volume of the fluid necessary to be added to or released from the tubing-casing annulus to maintain the fluid within an optimal pressure range in the tubing-casing annulus for normal operations in which the subsurface safety valve is in the open state;

receiving, by the control unit, an indication of an emergency condition; and transmitting, by the control unit and in response to the receipt of the indication of the emergency condition, a signal to activate a release valve to release from the tubing-casing annulus a volume of fluid sufficient to cause the subsurface safety valve to switch from the open state to the closed state.

12. The method of claim 11, further comprising transmitting, by the control unit and in response to a determination by the control unit that an additional volume of fluid is necessary to maintain the fluid within the optimal pressure range in the tubing-casing annulus for normal operations, a signal to activate a pump to add the additional volume of fluid to the tubing-casing annulus.

13. The method of claim 12, further comprising transmitting, by the control unit and in response to a determination by the control unit that a release of fluid is necessary to maintain the fluid within the optimal pressure range in the tubing-casing annulus, a signal to activate the release valve to release the fluid in a volume sufficient to maintain the fluid within the optimal pressure range.

14. The method of claim 13, wherein the pump draws the additional volume from a tank disposed at the surface, and wherein the tank is configured to receive the fluid released from the tubing-casing annulus.

15. The method of claim 11, wherein subsurface safety valve comprises:

a main body with a central bore therethrough, the central bore fluidically connected to the production tubing;

a closure member that permits fluid flow through the central bore when in an open position and that prevents fluid flow through the central bore when in a closed position, wherein the subsurface safety valve is in the open state when the closure member is in the open position and in the closed state when the closure member is in a closed position;

a pressure orifice through the main body having an outer end and an inner end, wherein the outer end is exposed to a pressure of fluid in the tubing-casing annulus; and a piston partially defining a piston chamber, the piston chamber fluidically connected to the inner end of the pressure orifice, the piston configured to move the closure member to the open position in response to an increase in pressure in the piston chamber.

16. The method of claim 15, wherein the piston is configured to allow the closure member to move from the open position to the closed position in response to a decrease in the pressure of the fluid in the tubing-casing annulus.

17. The method of claim 15, wherein a pressure of fluid in the piston chamber is equal to the pressure of the fluid in the tubing-casing annulus.

18. The method of claim 11, wherein a downhole boundary of the tubing-casing annulus is defined by an upper surface of an annular production packer element.

19. The method of claim 11, wherein the volume of fluid sufficient to cause the subsurface safety valve to switch from the open state to the closed state is determined based in part on the calculated expected thermal expansion or contraction of the fluid in the tubing-casing annulus based on the received measurements.

20. The method of claim 11, wherein the calculating an expected thermal expansion or contraction of the fluid in the tubing-casing annulus is based on the received measurements is in real-time with the received measurements.

* * * * *